US006843036B2

(12) United States Patent
Stewart, III

(10) Patent No.: US 6,843,036 B2
(45) Date of Patent: Jan. 18, 2005

(54) JOIST BRIDGING SYSTEM

(76) Inventor: Kenneth G. Stewart, III, P.O. Box 1117, Sarasota, FL (US) 34230

( * ) Notice: Subject to any disclaimer, the term of this patent is extended or adjusted under 35 U.S.C. 154(b) by 81 days.

(21) Appl. No.: 09/748,281

(22) Filed: Dec. 27, 2000

(65) Prior Publication Data

US 2002/0059771 A1 May 23, 2002

Related U.S. Application Data

(60) Provisional application No. 60/171,662, filed on Dec. 27, 1999.

(51) Int. Cl.[7] ..... E04H 12/04

(52) U.S. Cl. ..... 52/695; 52/655.1; 52/693; 52/696; 52/712; 137/362; 248/57; 248/74.1

(58) Field of Search ..... 52/643.1, 650.1, 52/652.2, 654.1, 655.1, 657, 695, 696, 697, 690, 637, 220.1, 693, 317, 713, 712, 342, 514; 248/56, 57, 74.1; 137/362

(56) References Cited

U.S. PATENT DOCUMENTS

| | | | | | |
|---|---|---|---|---|---|
| 682,086 | A | * | 9/1901 | Kearney | |
| 4,122,647 | A | * | 10/1978 | Kovar | 52/695 |
| 4,794,746 | A | * | 1/1989 | Ramer | 52/695 |
| 5,230,190 | A | * | 7/1993 | Schuette | 52/220.1 |
| 6,131,359 | A | * | 10/2000 | Duff | 52/706 |

* cited by examiner

*Primary Examiner*—Carl D. Friedman
*Assistant Examiner*—Yvonne M. Horton
(74) *Attorney, Agent, or Firm*—Barnes & Thornburg

(57) ABSTRACT

A system for reinforcing, securing and stiffening a plurality of joists comprising a band extending across the top of a series of joists and connected to the joists and with a series of truss members attached to the underside of the band and extending between and abutting two adjacent joists.

17 Claims, 3 Drawing Sheets

JOIST BRIDGING SYSTEM

This application claims the benefit of priority from provisional application No. 60/171,662 filed Dec. 27, 1999.

BACKGROUND AND SUMMARY OF THE INVENTION

The present invention relates to a system for securing and stiffening sequential floor joists of a wooden framed building. More particularly, the present invention relates to system for providing reinforcing structure within successive joist bays between the sequential floor joists.

BRIEF DESCRIPTION OF THE DRAWINGS

The detailed description particularly refers to the accompanying figures in which.

DETAILED DESCRIPTION OF THE DRAWINGS

Figure 1:
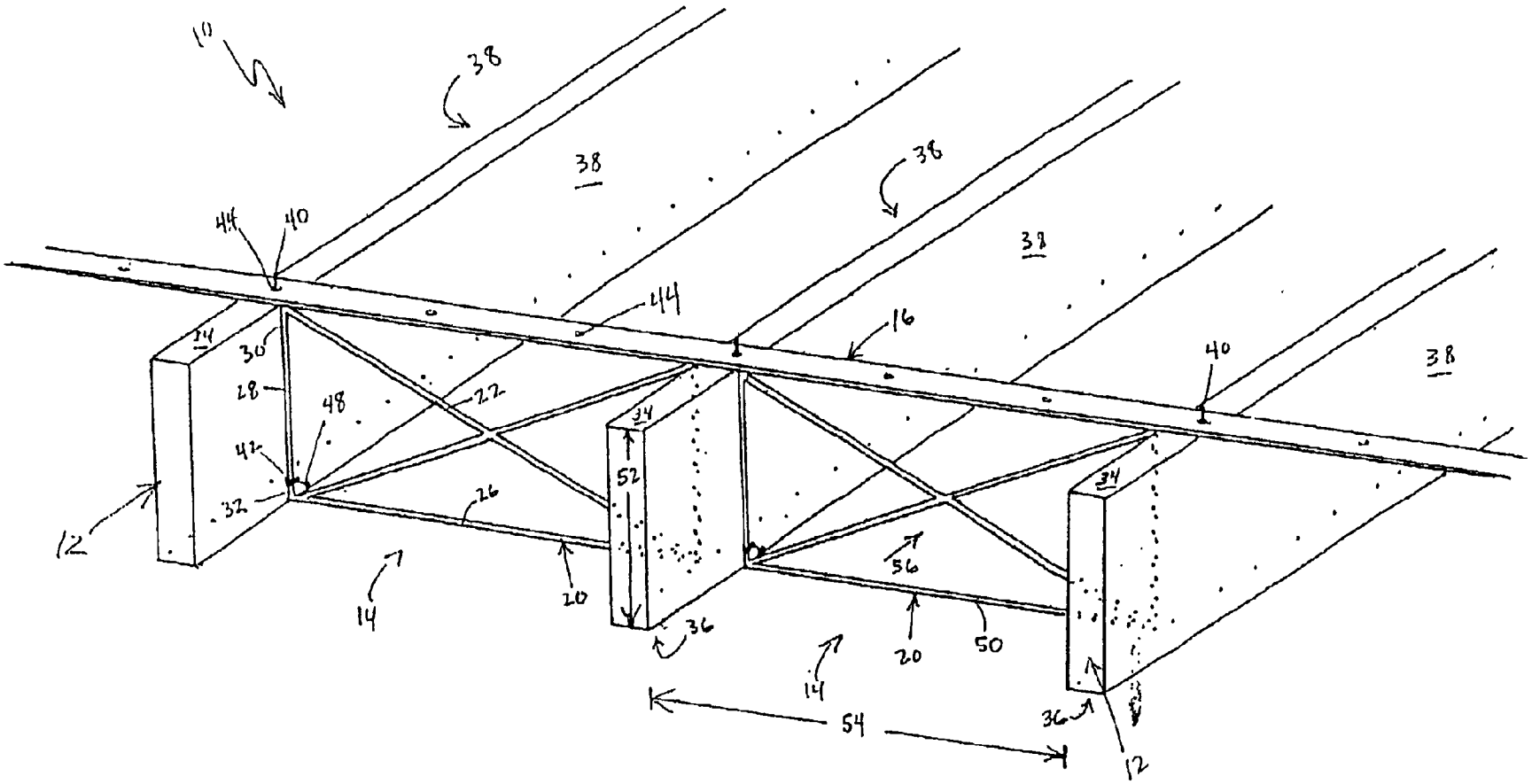
FIG. 1 is a perspective view of a bridging system in accordance with the present invention coupled to three successive floor joists showing the bridging system having a band which bridges and lays over the top faces of the three successive floor joists and two box units coupled to the band and positioned to lie within successive joist bays between the three successive floor joists.
Figure 2:
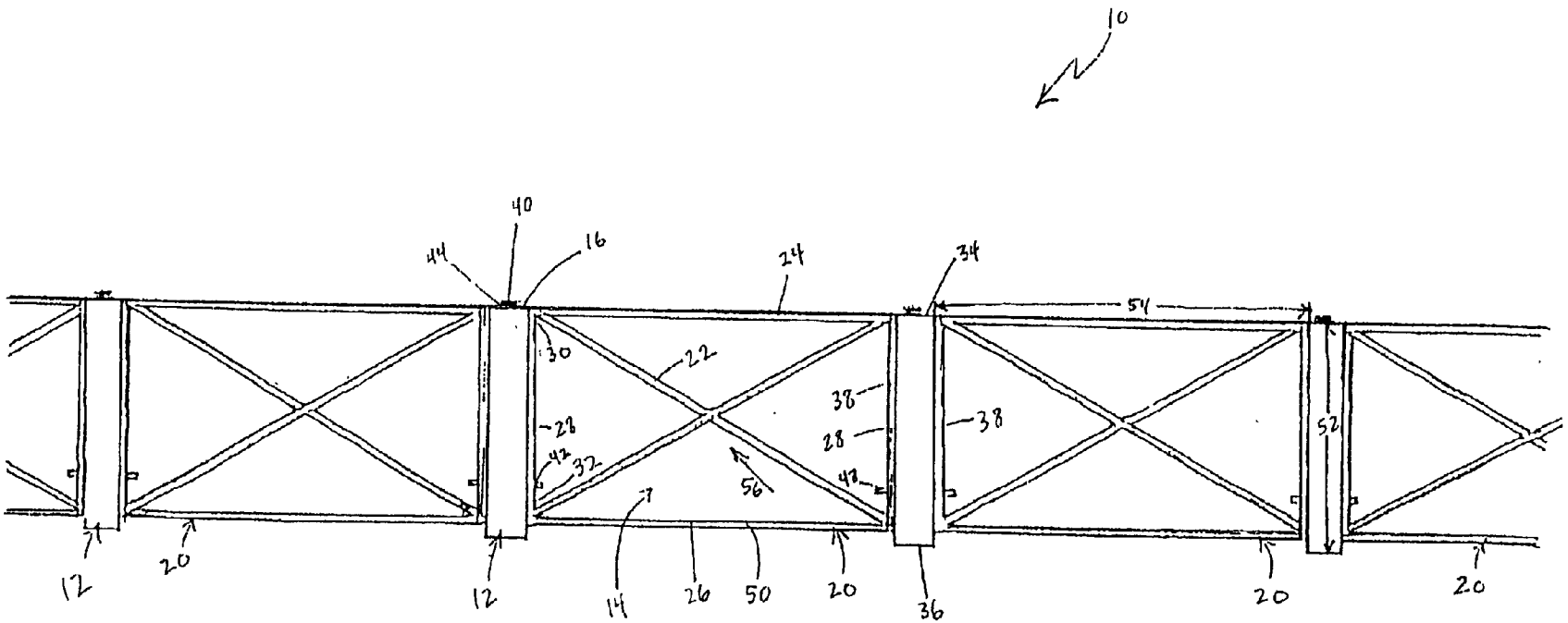
FIG. 2 is side elevation view of a bridging system in accordance with the present invention coupled to several successive floor joists showing the bridging system having a band which bridges and lays over the top faces of the successive floor joists and multiple box units, including X-bracing members, coupled to the band and positioned to lie within successive joist bays between the successive floor joists.

As shown in FIGS. 1 and 2, a joist bridging system 10 includes a band 16 and multiple box units 20 coupled to band 16. The entire joist bridging system 10 is illustrated in conjunction with a series of successive floor joists 12. As best shown in FIG. 1, band 16 includes multiple nail holes 44 spaced along the length of band 16 so that nails or other fasteners 40 may be nailed through nail holes 44 in band 16 and into joists 12, thereby securing band 16 to joists 12. Joists 12 are typically made of wood and are spaced evenly (typically 16 inches on center apart) to form the floor structure of a wood framed building. Joists 12 run lengthwise, in parallel spaced relation to each other, in the floor structure of a wood framed building. As shown in FIGS. 1 and 2, each joist 12 includes a top face 34 facing upwardly, a bottom face 36 facing downwardly, and two side faces 38 spanning therebetween.

During use, band 16 is laid across top faces 34 of joists 12 and perpendicular to joists 12 (shown best in FIG. 1). With band 16 thus positioned, fasteners 40 may be placed through nail holes 44 and into top faces 34 of joists 12, thereby coupling band 16 to top faces 34 of joists 12. Between successive joists 12 are joist bays 14 separating successive joists 12. With band 16 coupled to top faces 34 of joists 12, box units 20, which are coupled to band 16 by welding, clips, adhesives, etc. (not shown), are positioned to lie within successive joist bays 14.

Each successive box unit 20 includes a perimeter portion 50 and an X-bracing member 22 coupled within. Each perimeter portion 50 comprises a top box member 24 (shown in FIG. 2), a bottom box member 26, and two side box members 28 positioned to lie therebetween and connecting top box member 24 to bottom box member 26. Each side box member 28 includes a top 30 and a bottom 32. The dimensions of box units 20 are such that when placed within successive joist bays 14, side box members 28 are positioned to lie adjacent side faces 38 of successive joists 12. The entire box unit 20 could be constructed of 3/16" (0.476 cm) metal rod. However, it is within the scope of this disclosure to construct box units 20 using any one of a number of rigid construction materials, such as plastic, wood, etc.

Further, the top box member could be eliminated under which circumstances the side members 28 would be coupled to the band 16.

With the entire joist bridging system thus positioned, box units 20 are secured to joists 12 using nail clips 42 coupled at bottoms 32 of side box members 28. The clip could be cast integrally with the box member or welded thereto either to the bottom 32 or the side 28 or to both. Multiple nailing points could be provided such as multiple clips 42, holes in the sides 28 for nailing apertures or additional nailing flags such as formed in common joist hangars. The clips could be wings formed on the side box members or wings attached by clamps secured to the side member. Typically, nails 48 are driven through nail clips 42 and into side faces 38 of joists 12, thereby rigidly securing box units 20 and the entire joist bridging system 10 to successive joists 12. However, any one of a number of other clasps, fasteners, etc. available on the market may be used instead of nail clips 42 to secure box units 20 to joists 12. In this way, joist bridging system 10 is secured to joists 12 via fasteners 40 through band 16 at top faces 34 and via nails 48 through nail clips 42 at side faces 38. This provides a connection between successive joists 12 in the form of band 16 and a stiffening structure between successive joists in the form of box units 20. Moreover, with joist bridging device 10 secured to successive joists 12, band 16 provides a flat surface over the top faces 34 of joists 12 so that floor decking (not shown) placed over top faces 34 of joists 12 is unimpeded and deflection of the bands substantially eliminated or reduced.

It is within the scope of this disclosure to use joist bridging devices for any number and/or arrangement of floor joists 12 such as joists of the wood type. Floor structures comprising various numbers of evenly spaced, successive, floor joists are shown, for example, in FIGS. 1 and 2. However, joist bridging system 10 may be constructed to accommodate other arrangements of floor joists wherein the number, spacing, or other parameter is varied. For example, it is within the scope of this disclosure to vary the dimensions of box units 20 depending on the dimensions of joist bays 14. The dimensions of joist bays 14 are a function of the height 52 of joists 12 and the distance 54 between successive joists 12 employed in the particular building on which joist bridging system 10 is used.

Figure 3:
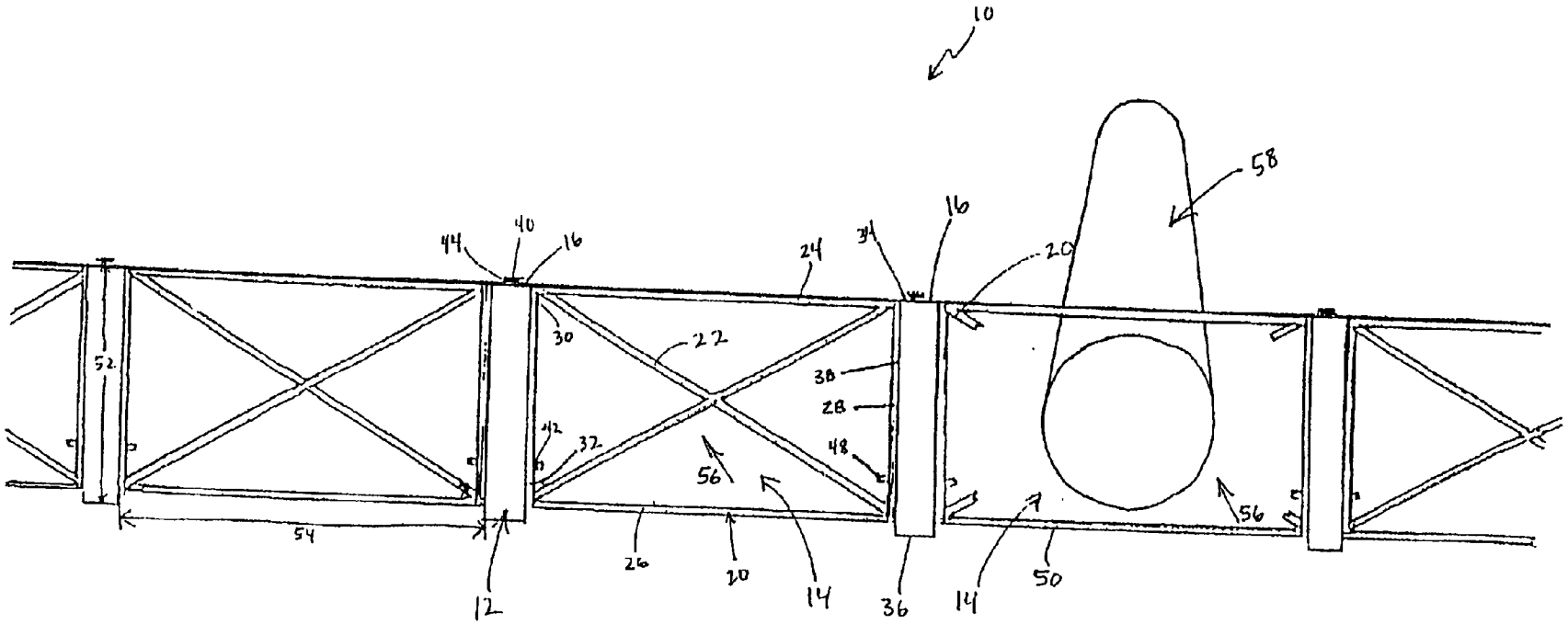
FIG. 3 is a side elevation view of the bridging system of FIG. 2 showing one of the multiple box units with its X-bracing member removed and duct work positioned to extend through the perimeter of the box unit and within the joist bay.

With joist bridging system 10 positioned as described above, as shown in FIG. 3, any X-bracing member 22 may be removed leaving only perimeter portion 50 of box unit 20 intact and thereby allowing for an unobstructed passageway 56 through box unit 20. If X-bracing member 22 is constructed of metal rod, it may be removed by cutting. It is also within the scope of this disclosure to include fracture zones or scored areas on X-bracing member 22 so that it may be simply knocked out using a hammer or other device. This embodiment is particularly well suited when X-bracing member 22 is constructed of a stiff, brittle material such as certain plastic materials. The addition of fracture zones on plastic X-bracing 22 near perimeter 50 will not sacrifice the structural integrity of X-bracing 22, but will allow X-bracing 22 to break cleanly out of perimeter 50 when hit with a hammer or other device.

The removal of X-bracing 22 may be desirable if mechanical fixtures, such as duct work 58 (shown in FIG. 3), need to extend through perimeter portion 50 and within joist bay 14. With X-bracing member 22 removed, perimeter portion 50 coupled to band 16 still provides structure to connect and stiffen successive floor joists 12, but allows for the placement of duct work 58 or other fixtures within joist bay 14.

What is claimed is:

1. A system for stiffening and securing adjacent joists comprising:

a flat band of substantially uniform height and having a length of at least the distance spanning three joists, the band configured to rest upon and be secured to a top edge surface of the at least three joists, at least two truss members having an upper top surface secured to an underside of the band by any one of welding, clips and adhesives so as to lie between the joists and with each truss extending between two joists and with the at least two truss members aligned along the band, the at least two truss members each having vertical side members, the at least two truss members each having a length equal to a spacing between joists so that when the bands are secured to a top side of the at least three joists, the side members of each truss member abut sides of two joists to hold the at least three joists in a vertical orientation at a specified distance between the at least three joists, wherein there are a plurality of bands, and wherein the bands are placed on top of the at least three joists spaced apart from one another along the length of each joist.

2. The stiffening system of claim 1 wherein the truss is configured as a rectangular box.

3. The stiffening system of claim 2 wherein the truss also has an X-shaped brace extending between the corners of the box.

4. The stiffening system of claim 1 wherein the vertical side members of the truss are provided with apertures for placement of mechanical connectors to secure the side members of the truss to a side of a joist.

5. A system for stiffening and securing adjacent joists comprising:

a flat band of substantially uniform height and having a length of at least the distance spanning three joists, the band configured to rest upon and be secured to a top edge surface of the at least three joists, at least two truss members having an upper top surface secured to an underside of the band by any one of welding, clips and adhesives so as to lie between the joists and with each truss extending between two joists and with the at least two truss members aligned along the band, the at least two truss members each having vertical side members, the at least two truss members each having a length equal to a spacing between joists so that when the bands are secured to atop side of the at least three joists, the side members of each truss member abut sides of two joists to hold the at least three joists in a vertical orientation at a specified distance between the at least three joists, wherein the band has fastener openings therein which openings are spaced along the length of band to at least have an opening alignable with the top edge of each joist covered.

6. The stiffening system of claim 5 wherein the truss is configured as a rectangular box.

7. The stiffening system of claim 6 wherein the truss also has an X-shaped brace extending between the corners of the box.

8. The stiffening system of claim 5 wherein the vertical side members of the truss are provided with apertures for placement of mechanical connectors to secure the side members of the truss to a side of a joist.

9. A system for stiffening and securing adjacent joists comprising:

a flat band of substantially uniform height and having a length of at least the distance spanning three joists, the band configured to rest upon and be secured to a top edge surface of the at least three joists, at least two truss members having a top surface secured to an underside of the band by any one of welding, clips and adhesives so as to lie between the joists and with each truss extending between two joists and with the at least two truss members aligned along the band, the at least two truss members each having vertical side members, the at least two truss members each having a length equal to a spacing between joists so that when the bands are secured to a top side of the at least three joists, the side members of each truss member abut sides of two joists to hold the at least three joists in a vertical orientation at a specified distance between the at least three joists, wherein the truss is configured as a rectangular box.

10. The stiffening system of claim 9 wherein the truss also has an X-shaped brace extending between the corners of the box.

11. A system for stiffening and securing adjacent joists comprising:

a flat band of substantially uniform height and having a length of at least the distance spanning three joists, the band configured to rest upon and be secured to a top edge surface of the at least three joists, at least two truss members having a top surface secured to an underside of the band by any one of welding, clips and adhesives so as to lie between the joists and with each truss extending between two joists and with the at least two truss members aligned along the band, the at least two truss members each having vertical side members, the at least two truss members each having a length equal to a spacing between joists so that when the bands are secured to a top side of the at least three joists, the side members of each truss member abut sides of two joists to hold the at least three joists in a vertical orientation at a specified distance between the at least three joists, wherein the vertical side members of the truss are provided with apertures for placement of mechanical connectors to secure the side members of the truss to a side of a joist.

12. A system for stiffening and securing adjacent joists comprising:

a band having a length of at least the distance spanning three joists, the band configured to rest upon and be secured to a top edge surface of the at least three joists, at least two truss members secured to an underside of the band by any one of welding, clips and adhesives so as to lie between the joists and with each truss extending between two joists and with the at least two truss members aligned along the band, the at least two truss members each having vertical side members, the at least two truss members each having a length equal to a spacing between joists so that when the bands are secured to a toy side of the at least three joists, the side members of each truss member abut sides of two joists to hold the at least three joists in a vertical orientation at a specified distance between the at least three joists, wherein the truss is configured as a rectangular box, wherein the truss also has an X-shaped brace extending between the corners of the box, wherein central portions of the x-shaped braces are removable to allow for an unobstructed passageway for duct work to extend between two of the at least three joists.

13. A system for stiffening and securing adjacent joists comprising:

a band having a length of at least the distance spanning three joists, the band configured to rest upon and be secured to a top edge surface of the at least three joists, at least two truss members secured to an underside of the band by any one of welding, clips and adhesives so as to lie between the joists and with each truss extending between two joists and with the at least two truss members aligned alone the band, the at least two truss members each having vertical side members, the at least two truss members each having a length equal to a spacing between joists so that when the bands are secured to a top side of the at least three joists, the side members of each truss member abut sides of two joists to hold the at least three joists in a vertical orientation at a specified distance between the at least three joists, wherein there are a plurality of bands, and wherein the bands are placed on top of the at least three joists spaced apart from one another along the length of each joist, wherein the truss is configured as a rectangular box, wherein the truss also has an X-shaped brace extending between the corners of the box, wherein central portions of the x-shaped braces are removable to allow for an unobstructed passageway for duct work to extend between two of the at least three joists.

14. A system for stiffening and securing adjacent joists comprising:

a band having a length of at least the distance spanning three joists, the band conjured to rest upon and be secured to a top edge surface of the at least three joists, at least two truss members secured to an underside of the band by any one of welding, clips and adhesives so as to lie between the joists and with each truss extending between two joists and with the at least two truss members aligned alone the band, the at least two truss members each having vertical side members, the at least two truss members each having a length equal to a spacing between joists so that when the bands are secured to a top side of the at least three joists, the side members of each truss member abut sides of two joists to hold the at least three joists in a vertical orientation at a specified distance between the at least three joists, wherein the band has fastener openings therein which openings are spaced along the length of band to at least have an opening alignable with the top edge of each joist covered, wherein the truss is configured as a rectangular box, wherein the truss also has an X-shaped brace extending between the corners of the box, wherein central portions of the x-shaped braces are removable to allow for an unobstructed passageway for duct work to extend between two of the at least three joists.

15. The stiffening system of claim 12 wherein the central portions of the x-shaped braces have fracture zones to allow for knocking out the center of the x-shaped braces to provide the unobstructed passageway.

16. The stiffening system of claim 13 wherein the central portions of the x-shaped braces have fracture zones to allow for knocking out the center of the x-shaped braces to provide the unobstructed passageway.

17. The stiffening system of claim 14 wherein the central portions of the x-shaped braces have fracture zones to allow for knocking out the center of the x-shaped braces to provide the unobstructed passageway.

* * * * *